US005643630A

United States Patent [19]

Hinzpeter et al.

[11] Patent Number: 5,643,630

[45] Date of Patent: Jul. 1, 1997

[54] METHOD AND DEVICE FOR DEPOSITING PULVERIZED LUBRICANTS OR PARTING COMPOUNDS ON THE PRESSING TOOLS OF TABLETTING MACHINES

[75] Inventors: Jürgen Hinzpeter; Ulrich Zeuschner, both of Schwarzenbek; Hans-Joachim Pierags, Lübeck; Peter Lüneburg, Berkentin; Elke Wittenberg, Gülzow; Ulrich Arndt, Lauenburg, all of Germany

[73] Assignee: Wilhelm Fette GmbH, Schwarzenbek, Germany

[21] Appl. No.: 415,723

[22] Filed: Apr. 3, 1995

[30] Foreign Application Priority Data

Apr. 8, 1994 [DE] Germany ..... 44 12 117.2

[51] Int. Cl.[6] ..... B05D 7/22

[52] U.S. Cl. ..... 427/133; 425/345; 425/353; 427/110; 427/182; 427/230; 427/232; 427/421

[58] Field of Search ..... 427/133, 232, 427/230, 180, 182, 421; 425/350, 345, 353

[56] References Cited

U.S. PATENT DOCUMENTS

| | | | |
|---|---|---|---|
| 4,832,880 | 5/1989 | Staniforth | 427/133 |
| 5,213,738 | 5/1993 | Hampton et al. | 264/113 |
| 5,350,548 | 9/1994 | Hinzpeter | 244/404 |
| 5,356,577 | 10/1994 | Boldis | 427/133 |

FOREIGN PATENT DOCUMENTS

| | | |
|---|---|---|
| 572 816 | 12/1993 | European Pat. Off. . |
| 38 11 260 | 10/1989 | Germany . |
| 48-20103 | 6/1973 | Japan . |

OTHER PUBLICATIONS

Derwent Report No. 36116U–B(Abstract of JP 48–20103, Jun. 19, 1973).

Derwent WP1 record No. 89–294117/41(Abstract of DE 3811260 Oct. 1989).

*Primary Examiner*—Janyce Bell
*Attorney, Agent, or Firm*—Vidas, Arrett & Steinkraus PA

[57] ABSTRACT

A method of depositing dosed quantities of pulverized lubricants or parting compounds on the materials contacting surfaces of pressing tools of tabletting machines, according to which the parting compound uniformly distributed by a gaseous transport medium is blown on the surfaces, said parting compound during operation of said tabletting machine being continuously blown on the used surfaces and being removed from the areas adjacent to the used surfaces by suction continuously.

5 Claims, 1 Drawing Sheet

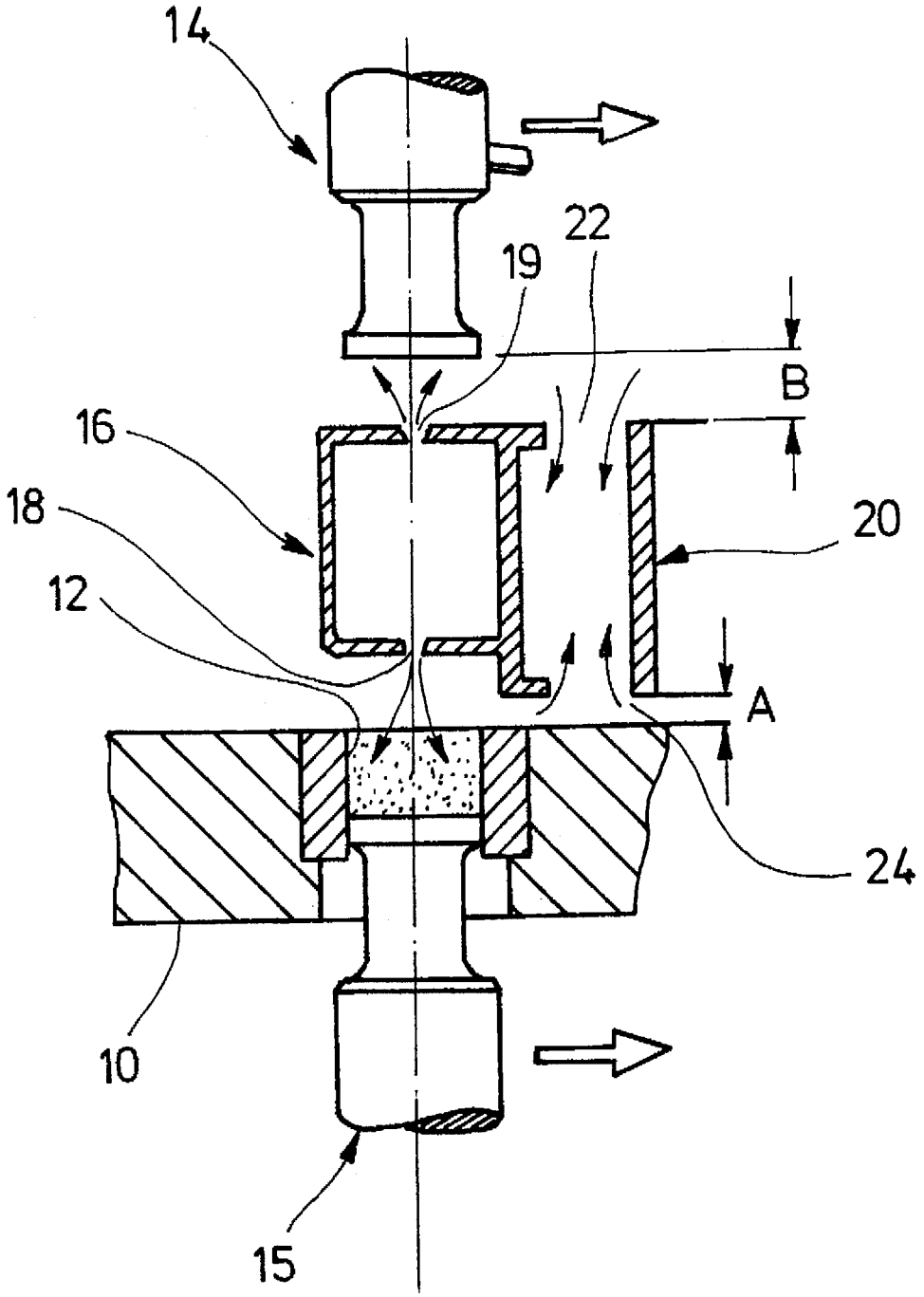
14
22
19
B
16
18
20
12
A
24
10
15

METHOD AND DEVICE FOR DEPOSITING PULVERIZED LUBRICANTS OR PARTING COMPOUNDS ON THE PRESSING TOOLS OF TABLETTING MACHINES

FIELD OF THE INVENTION

The invention relates to a method of depositing dosed quantities of pulverized lubricants or parting compounds on the used surfaces of pressing tools of tabletting machines.

BACKGROUND OF THE INVENTION

Rotary tabletting machines, as they are described in the EP 0 572 816, comprise a matrix disk rotatably driven around a vertical axis which matrix disk includes matrix bores arranged on a circle. To said matrix bores upper and lower punches are associated which are rotating in synchronism with the matrix disk and compress pulverized material filled into the matrix bores. The punches are actuated by suitable control cams for selectively setting free the matrix bores and carrying through the compressing procedure, respectively. During filling in a filling station, the lower punch is arranged in a lower position within the matrix bore, while the upper punch is spaced apart from the matrix disk.

The compression of many substances makes a lubricant or parting compound necessary for preventing the tablet from bonding to the pressing tools as well as too a high friction while ejecting the tablet from the matrix bores. It has become known to use magnesium stearate as a pulverized parting compound. From the DE 38 11 261 it also has become known to use liquids finely dispersed in gases.

It has become known to finely disperse the lubricant in the material to be compressed, e.g. by adding or spraying magnesium stearate on the material to be compressed. Thereat the amount of lubricants is 0.5 to 1% of the material to be compressed. The relatively high concentration of the lubricant is necessary for providing on the surface of the tablet a sufficient quantity of said lubricant so as to prevent the tablet from bonding to the tool. In many cases, however, such a high concentration of lubricants is not desirable.

Another possibility is to deposit the lubricant on the matrix bore and lower punch, for instance by a clock-pulse blowing, as described in the DE 38 11 260. A Venturi nozzle is arranged in a tabletting machine directly in front of the punch and the matrix opening. A controlled compressed-air supply serves the purpose of blowing off so-called powder packages on the used surfaces. The known device involves quite some expenditure, especially with respect to the control system, and there is a risk that too a big quantity of the lubricant is discharged which then is deposited on the surfaces adjacent to the matrix bore and the punch shafts in an undesired way. Besides, the known method can be carded out at relatively low speeds only.

SUMMARY OF THE INVENTION

It is the object of the invention to provide a method of depositing dosed quantities of pulverized lubricants and parting compounds on the materials contacting surfaces of pressing tools of tabletting machines which only requires a small amount of lubricants and parting compounds and can also be carded out at very high speeds.

This technical problem is resolved by the features of the inventive method for depositing dosed quantities of pulverized lubricants or parting compounds on the material contacting surfaces of pressing tools of tabletting machines, according to which the parting compound is blown onto the materials contacting surfaces by gas transport medium so as to uniformly distribute the parting compound thereon, wherein, during operation of said tabletting machine, the parting compound is continuously blown on the materials contacting surfaces and any excessive parting compound is removed from the areas adjacent to the materials contacting surfaces by continuous suction.

BRIEF DESCRIPTION OF THE DRAWINGS

The only figure shows a section through a matrix disk in the area of an upper and lower punch with a device according to the invention.

DETAILED DESCRIPTION OF THE INVENTION

According to the inventive method, the parting compound during operation of the tabletting machine is continuously blown on the materials contacting surfaces and any excessive parting compound is removed from the areas adjacent to the used surfaces by suction continuously.

According to the inventive method, the parting compound is continuously deposited on the punches or delivered to the matrix bore so that there is no upper limit with respect to the speed. The lubricant quantity deposited on the materials contacting surfaces is dosed and can be held to a minimum. It is essential for the invention, however, that a removal of the lubricant by suction takes place together with the lubricant blowing, that is directly adjacent to the materials contacting surfaces. In this way, any excessive parting compound which does not reach the materials contacting surface and is dispersed above the matrix disk more or less "cloud-like" is removed by suction so that the amount of lubricant actually depositing on the used surfaces or on the tablet is extremely small, preferably smaller than 0.02%, based upon the substance to be compressed.

The lubricant and parting compound is swirled at exactly dosed quantities, e.g. within a Venturi nozzle, wherefrom it is then led to a corresponding discharge nozzle of the tabletting machine then. As a result of a corresponding adjustment of size and shape of the nozzle port, the blowing pressure as well as the distance of the discharge nozzle from the upper punch and the matrix disk, a uniform distribution of the lubricant on the upper punch and within the matrix bore is achieved. Within the matrix bore, any kind of swirl chamber effect is provided which even is increased by the removal by suction with the aid of a suitable suction nozzle. There is obtained a homogenous, minimum coating of the matrix wall and the pressing surfaces of the punch.

Furthermore, the reduction of lubricants and parting compounds in the tablets has the advantage that the desired strength of the tablet can be provided by applying a substantially reduced amount of pressure. In this way, a more insignificant wear of the tools and a shorter decay time of the tablets is achieved. Finally, the reduction of the lubricant and parting compound decreases the corresponding material requirements as well.

There have become known so-called double rotary machines, according to which the production of a tablet is performed on half of a circular path of the matrix disks. Accordingly, there are associated to the matrix disk two filling stations. In rotary machines of that type, according to an embodiment of the inventive method, provision is made for the depositing means of lubricants provided in the moving direction in front of the unused filling means to be activated and for the depositing means arranged in front of the used filling station to be inactivated. Thus, it is prevented that any lubricant is blown on the material in the matrix bores.

Various constructive solutions are possible for realizing the inventive method. One of these solutions, according to an embodiment of the invention, is to arrange a discharge nozzle above the matrix disk and slightly spaced apart from the same which comprises a lower nozzle opening being in alignment with the circular path of the matrix bores and a nozzle port being in alignment with the circular path of the upper punches. The nozzle ports, according to a further development of the invention, preferably are formed as radially arranged grooves, the length of which may be approximately identical to the diameter of a matrix bore. The lower suction port, according to an embodiment of the invention, is arranged at a lower distance from the matrix disk than the lower discharge nozzle port. Thus, any excessive material can be efficiently removed from the surface of the matrix disk by suction so as to prevent any accumulation of material on the matrix disk. The distance of the upper suction port from the upper punch needs to be adjusted so as to be larger in order to prevent any material adhering to the upper punches from being removed by suction and prevent the punch shaft from being coated. Preferably, the discharge nozzle is arranged in front of the suction nozzle in moving direction.

The invention will be more detailedly explained hereinafter with the aid of a drawing.

The only figure shows a section through a matrix disk in the area of an upper and lower punch with the device according to the invention.

The figure shows a matrix disk 10 of a tabletting machine not described hereinafter which comprises matrix bores arranged on a circle, one of which matrix bores being shown at 12. One upper punch 14 and one lower punch 15 is associated to the matrix bore 12. They cooperate with the matrix disk 10 in a known way, as approximately described in the EP 0 572 816, and move in the direction of the arrows shown. The function and the structure of a tabletting machine are not mentioned in detail hereinafter.

Above the matrix disk 10 a discharge nozzle 16 is stationarily arranged which comprises a lower nozzle port 18 and an upper nozzle port 19. The nozzle ports 18, 19 are shaped like slots and extend radially with respect to the matrix disk 10 so as to be capable of approximately extending over the diameter of the matrix bore 12. The tube-like or box-shaped nozzle 16 is connected to a Venturi nozzle not shown, within which a gaseous medium, e.g. air, and a powdery lubricant and parting compound, e.g. magnesium stearate, are mixed homogeneously. The mixture consisting of air and a parting compound is introduced into the discharge nozzle 16 under pressure and is blown off via the upper and lower nozzle ports 19, 18 in accordance with the arrows shown, said mixture being directed towards the pressing surface of the upper punch 14 and towards the walls of the matrix bore 12 as well as the pressing surface of the lower punch 15. Directly adjacent to the discharge nozzle 16 a suction nozzle 20 is stationarily arranged, the one wall of which is formed by the associated wall of the discharge nozzle 16. It is box-shaped in section and connected to a low-pressure source not shown. It comprises an upper suction port 22 and a lower suction port 24. As appears from the figure, the distance A between the lower port 24 and the upper surface of the matrix disk 10 is relatively small, in any case smaller than the distance of the lower nozzle port 18 from the matrix disk 10. It e.g. is 0.5 mm only. The distance B between the pressing surface of the upper punch 14 and the nozzle port 19 resp. the upper suction port 22 is slightly larger and is e.g. 1.5 mm, which value is identical to that of the distance of the lower nozzle port 18 from the matrix disk 10. The excessive mixture of air and powdery parting compound is absorbed by the discharge nozzle 20, as demonstrated by the corresponding arrows. Consequently, no substance can be deposited on the matrix disk 10, not even on the shaft of the upper punch 14. The beforementioned spacings and the nozzle ports as well as the air volume and the air pressure or the quantity of the parting compound are harmonized with each other to such an extent that only a minimum quantity is deposited on the materials contacting surfaces of the pressing tools while all excessive material is removed with the aid of the suction nozzle 20, wherefrom it is delivered to a corresponding pollution abatement facility together with the material dust from the tabletting machine.

We claim:

1. A method of depositing dosed quantities of a pulverized lubricant or parting compound on the materials contacting surfaces of pressing tools of a rotary tabletting machine having upper and lower pressing tools rotated about an axis along a circular orbit and axially displacable by a control means, said pressing tools being aligned with molding holes of a disc rotating about said axis synchronously with said pressing tools, the method including the steps of:

continuously blowing said lubricant or parting compound onto said materials contacting surfaces through upper and lower nozzle orifices adjacent, respectively to said upper and said lower pressing tools, said nozzle orifices being supplied from a source for said lubricant or release agent and continuously removing excess of said lubricant or parting compound by a suction nozzle having upper and lower suction openings adjacent to and downstream of said upper and lower nozzle orifices when looking in direction of rotation of said pressing tools.

2. The method according to claim 1, characterized in that in a double rotary machine comprising two filling stations spaced apart from each other peripherically the parting compound is added in moving direction in front of the unused filling station but is not added in front of the used filling station.

3. A rotary tabletting machine comprising:

upper and lower pressing tools (14, 15) rotated about an axis along a circular orbit and axially displacable by a controller, a matrix disc (10) having molding holes (12) therein rotating about said axis synchronously with said pressing tools, said pressing tools being aligned with the molding holes (12) of the matrix disc (10), a discharge nozzle (16) for continuously depositing dosed quantities of a pulverized lubricant or parting compound to the materials contacting surfaces of the pressing tools, said discharge nozzle operatively connected to a source for said lubricant or parting compound and including upper and lower nozzle ports (19, 18) adjacent, respectively to said upper and said lower pressing tools, and a suction nozzle (20) for continuously removing excess of said lubricant or parting compound, said nozzle having upper and lower suction ports (22, 24) adjacent to and downstream of said upper and lower nozzle ports, respectively, when looking in direction of rotation of said pressing tools.

4. The machine according to claim 3, characterized in that said nozzle ports (19, 18) are formed by radially arranged grooves.

5. The machine according to claim 3, characterized in that said lower suction port (24) is arranged at a lower distance from said matrix disk (10) than said lower discharge nozzle (18).

* * * * *

UNITED STATES PATENT AND TRADEMARK OFFICE
CERTIFICATE OF CORRECTION

PATENT NO. : 5,643,630

DATED : July 1, 1997

INVENTOR(S) : JURGEN HINZPETER ET AL.

It is certified that error appears in the above-identified patent and that said Letters Patent is hereby corrected as shown below:

Title page, item [57],
In the Abstract:

Last line, delete "used" and insert -- materials contacting --;

Col. 1, line 52, delete "carded" and insert -- carried --;

Col. 2, line 19, delete "used" and insert -- materials contacting --;

Col. 2, line 38, delete "then";

Col. 3, line 24, before "drawing" delete "a" and insert -- the --.

Col. 3, line 25, delete "The only figure shows a section through a matrix disk in the area of an upper and lower punch with the device according to the invention."

Signed and Sealed this

Sixth Day of April, 1999

*Attest:*

Q. TODD DICKINSON

*Attesting Officer*

*Acting Commissioner of Patents and Trademarks*